US006695370B2

(12) United States Patent
Johnson

(10) Patent No.: US 6,695,370 B2
(45) Date of Patent: Feb. 24, 2004

(54) GOLF BALL RETRIEVAL DEVICE AND METHOD

(76) Inventor: Thomas L. Johnson, 416 Morningside Dr., Lakeland, FL (US) 33803

( * ) Notice: Subject to any disclaimer, the term of this patent is extended or adjusted under 35 U.S.C. 154(b) by 9 days.

(21) Appl. No.: 10/232,178

(22) Filed: Aug. 29, 2002

(65) Prior Publication Data

US 2003/0042745 A1 Mar. 6, 2003

Related U.S. Application Data

(60) Provisional application No. 60/317,689, filed on Sep. 6, 2001.

(51) Int. Cl.[7] ..... A63B 47/02

(52) U.S. Cl. ..... 294/19.2; 56/400.21

(58) Field of Search ..... 294/19.2, 55, 66.1; 56/328.1, 332, 400.01, 400.15, 400.21

(56) References Cited

U.S. PATENT DOCUMENTS

| | | | | | |
|---|---|---|---|---|---|
| 960,247 | A | * | 6/1910 | Ball | 172/379 |
| 2,738,214 | A | * | 3/1956 | Zimmers | 294/19.2 |
| 3,115,740 | A | * | 12/1963 | Hartley et al. | 56/328.1 |
| 3,717,371 | A | * | 2/1973 | Halone | 294/19.2 |
| 4,635,987 | A | | 1/1987 | Hurtgam | |
| 5,246,260 | A | | 9/1993 | Racicot | |
| D362,038 | S | | 9/1995 | Schatz | |
| 5,482,338 | A | | 1/1996 | Hall | |
| 5,662,366 | A | | 9/1997 | Fraske | |
| 5,743,578 | A | | 4/1998 | Schuermann | |
| 5,758,915 | A | | 6/1998 | Quinn et al. | |

* cited by examiner

*Primary Examiner*—Dean J. Kramer
(74) *Attorney, Agent, or Firm*—Allen, Dyer, Doppelt, Milbrath & Gilchrist, P.A.

(57) ABSTRACT

A golf ball retriever includes a plate member with spaced apart tear shaped tines each having a leading edge and an opposing trailing edge, and a surface spaced apart from an opposing surface of an adjacent tine a distance greater than the diameter of a golf ball for enabling the tines to guide the golf ball between the spaced apart surfaces during a raking movement of the retriever. A flange extends along the trailing edge of each tine to reduce the distance between surfaces to less than the diameter of the golf ball for lifting the ball from its position typically within a muddy water hazard bottom and trapping the ball between the tines during a raking movement of the retriever.

26 Claims, 8 Drawing Sheets

GOLF BALL RETRIEVAL DEVICE AND METHOD

CROSS-REFERENCE TO RELATED APPLICATIONS

This application claims the benefit of U.S. Provisional Application No. 60/317,689 filed Sep. 6, 2001, the disclosure of which is hereby incorporated by reference.

FIELD OF THE INVENTION

The present invention relates to ball retrieval devices, and more particularly to a retrieval device adapted to retrieve golf balls from water hazards.

BACKGROUND OF THE INVENTION

Golfing is one of the most popular sports in the world with individual participation at an all time high. While well known to be generally an expensive game especially when played on better golf course, aside from the initial purchase of golf equipment and the anticipated cart and greens fees, the most significant expense incurred by the average golfer appears to be the purchase of golf balls. The loss of golf balls due to errant hits into known and unknown hazards such as rough grassy areas, tall vegetation, ponds, and water hazards is not only a major frustration to the golfer, but as described, a potential source of great expense. It is commonly accepted that most golf balls are lost in water hazards that are an integral part of the design of a golf course. Therefore, the ability to retrieve balls that are lost in any type of hazard, water or otherwise, is of great importance to most golfers, especially those with limited resources.

Golf ball retrieving rakes are well known in the golfing field and are relatively common. Golf ball retrievers are available for harvesting either individual or multiple balls from both water hazards as well as from dense vegetation where physical ingress and egress would make a ball otherwise difficult if not impossible to retrieve. Typically, golf ball retrievers are mounted to telescoping poles. In addition, most available golf ball retrieving devices include a variety of rakes, scoops, disks, and other variance, which are manufactured of metal, plastic, or a combination of such materials.

One commercially available retriever captures the ball by rolling over it, forcing it past rims on opposing rolling disks. Others are shaped as a scoop to rake the ball by plowing the soil or bottom surface of the lake. It is not unusual for such devices to get snagged on obstructions or debris such as grass, weeds, rocks, and roots thereby significantly disturbing ecologically sensitive natural habitat of waterfowl and dislodging and uprooting vegetative bottom growth. Such retrievers also require a greater effort in managing a raking and harvesting process.

There remains a need to overcome such problems typically found in the art of harvesting balls in vegetated, rocky, muddy or uneven bottom water hazards, as well as in dry hazards or golf course roughs. The present invention seeks to satisfy such a need.

SUMMARY OF THE INVENTION

In view of the foregoing background, the present invention provides a ball retrieval device and method for retrieving a ball from a water hazard and typical golf course hazards with a minimal disturbance to surfaces upon which the ball rests, and with a minimal effort to do so. Embodiments of the present invention enable the retrieval of multiple balls within a single raking operation while reducing the amount of debris collected, and without snagging the device on vegetation or typically uneven, muddy bottom surfaces.

These features and advantages in accordance with the present invention are provided by a ball retrieving device which may contain a combination of features including a plate member adapted for a raking movement thereof, at least two spaced apart tines carried by the plate member, each tine having a leading edge and an opposing trailing edge, and a surface extending therebetween spaced apart from an opposing surface of an adjacent tine a distance greater than the diameter of a ball for enabling the at least two tines to guide the ball therebetween, and a flange carried along the trailing edge of each tine and outwardly extending therefrom for reducing the distance to less than the diameter of the ball and enabling a trapping thereof during a raking movement of the device.

Embodiments of the device may include each tine being of generally rigid construction. Alternatively, the surface of one tine is parallel to the opposing surface of the adjacent tine. Further, each tine may comprise a teardrop shape partition wall, wherein the leading edge extends from a stem portion proximate the plate member to a generally arcuate capturing portion. In one alternate embodiment, the flange may include a tapered end portion extending from the leading edge of the tine. Embodiments of the device may further include an array of spaced apart tines having greater than two tines therein.

One embodiment of the plate member may include a distal end adapted for connection to a handle, a proximal end attached to each tine within the array, and an arcuate leading edge extending from opposing outermost tines within the array to the distal end. A handle will typically be operable with the plate member for pulling the plate member and thus the tines along a ground surface having balls positioned therewith. Alternatively, a line or the like may be may be connected to the plate member for providing the pulling and raking movement.

In yet other embodiments resulting from the teachings of the present invention, the plate member, the tines, and the flanges carried by the tines may have a unitary construction. Further, the unitary construction may be formed from a molded plastic material.

A method aspect of the invention includes moving the plate member in a direction for enabling the tines to be carried along the ground surface in a raking manner from traveling from leading edge to trailing edge, contacting a ball with the leading edge of at least one tine for guiding the ball between adjacent tines, continuing the moving for enabling the flanges to contact the ball in a capturing movement between the adjacent tines for holding the ball within the device, and lifting the device from the ground for retrieving the ball therefrom.

BRIEF DESCRIPTION OF THE DRAWINGS

A preferred embodiment of the invention as well as alternate embodiments are described by way of example with reference to the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
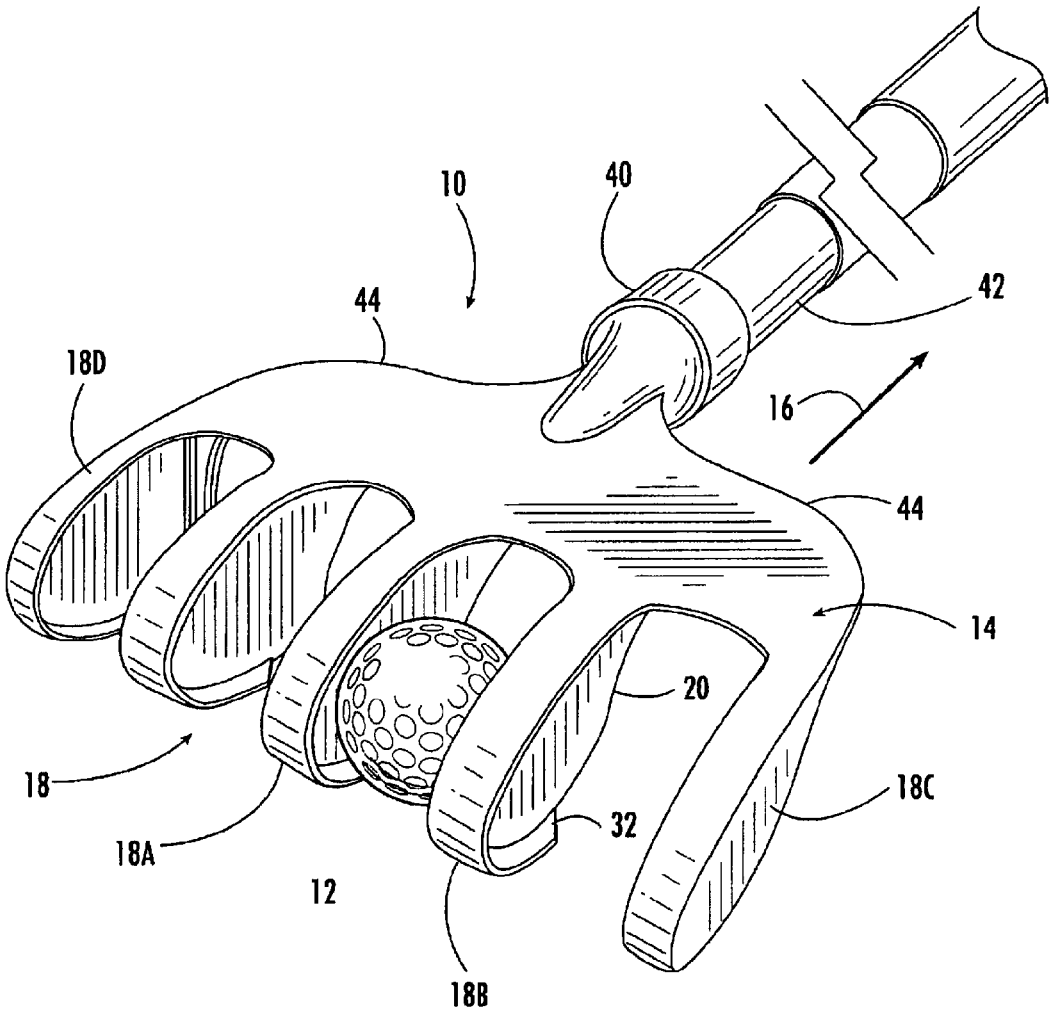
FIG. 1 is a top right, front perspective view of one embodiment of the present invention.
Figure 2:
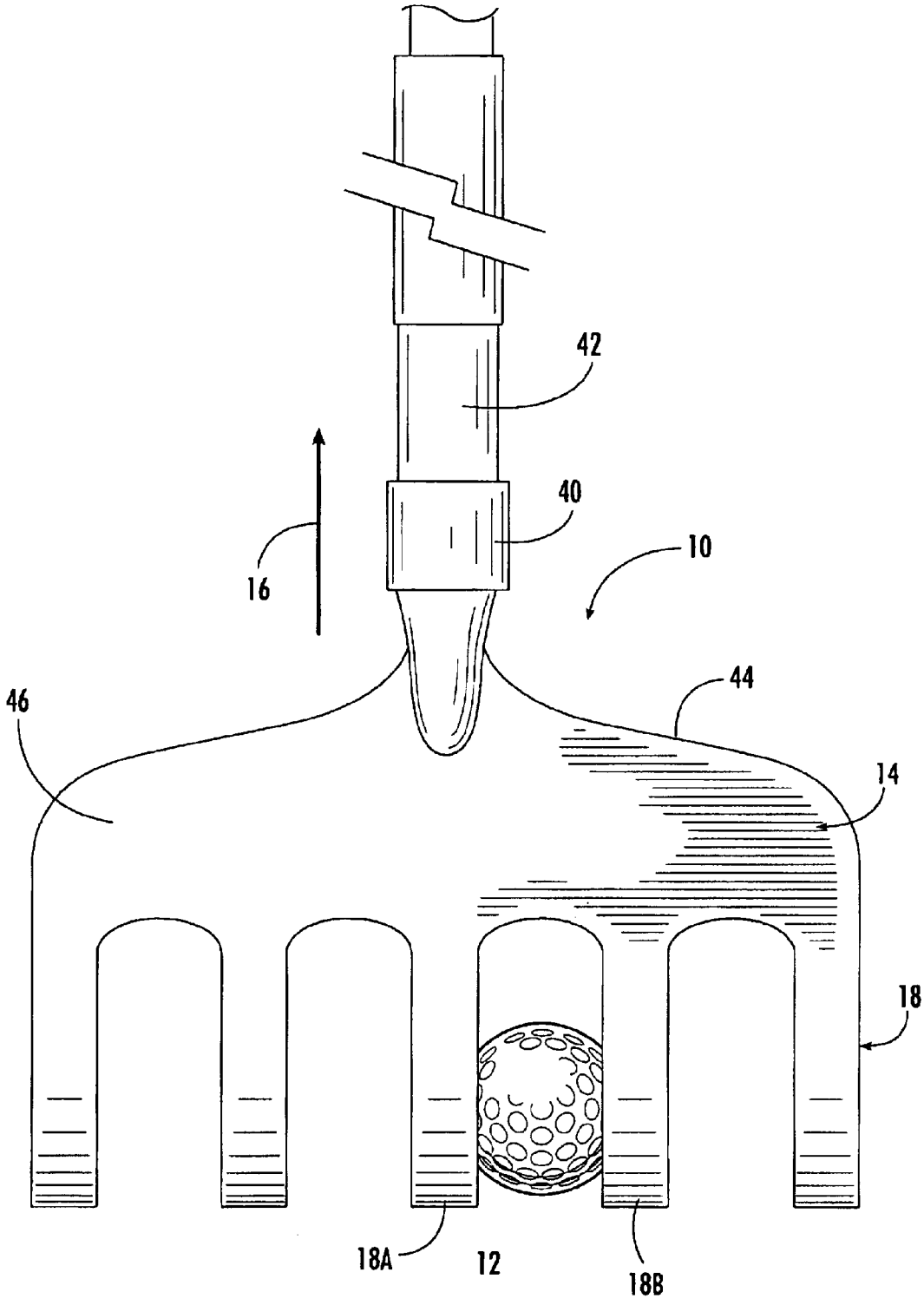
FIG. 2 is a top plan view of the embodiment of FIG. 1.
Figure 3:
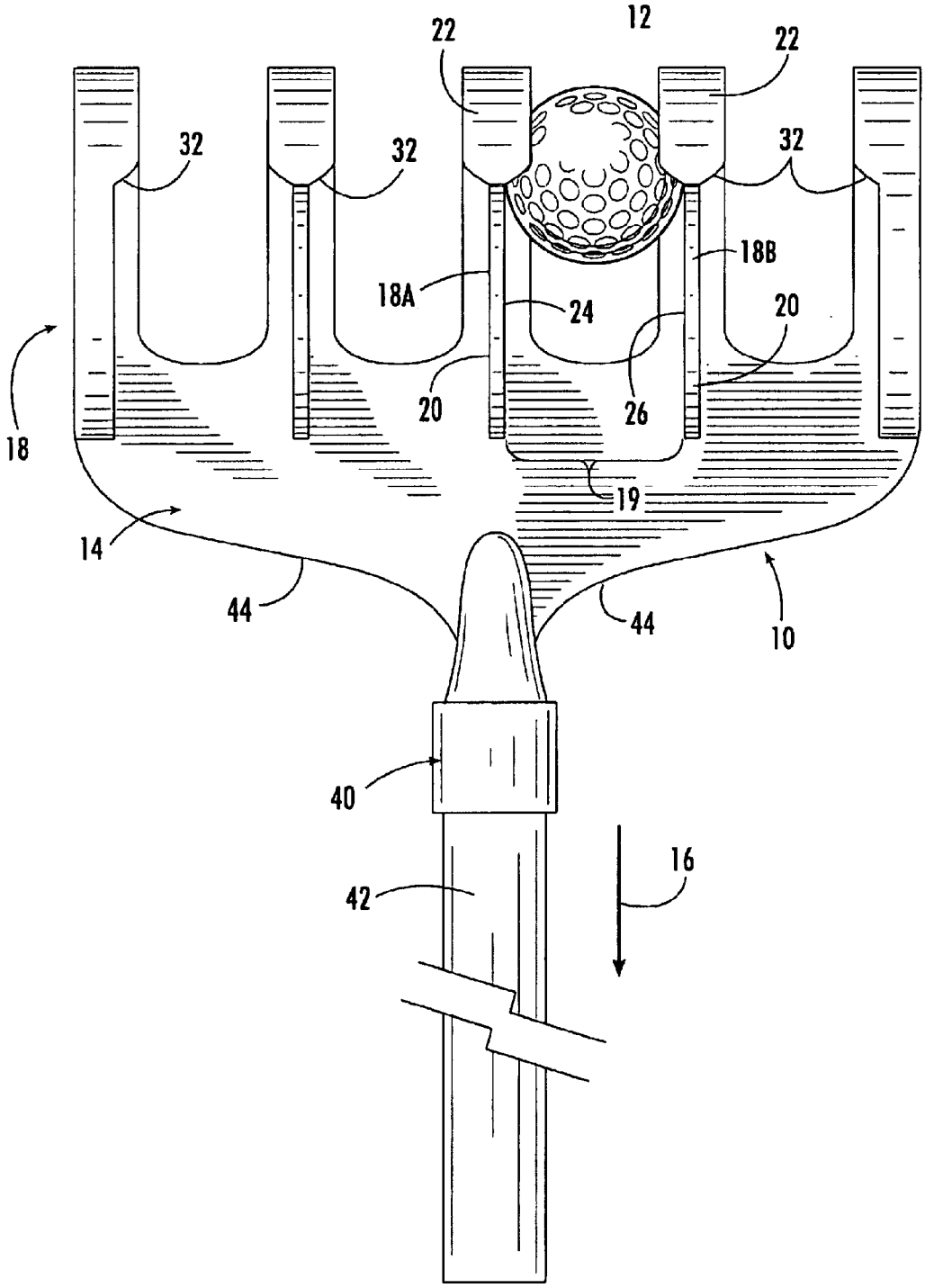
FIG. 3 is a bottom plan view of the embodiment of FIG. 1.
Figure 5:
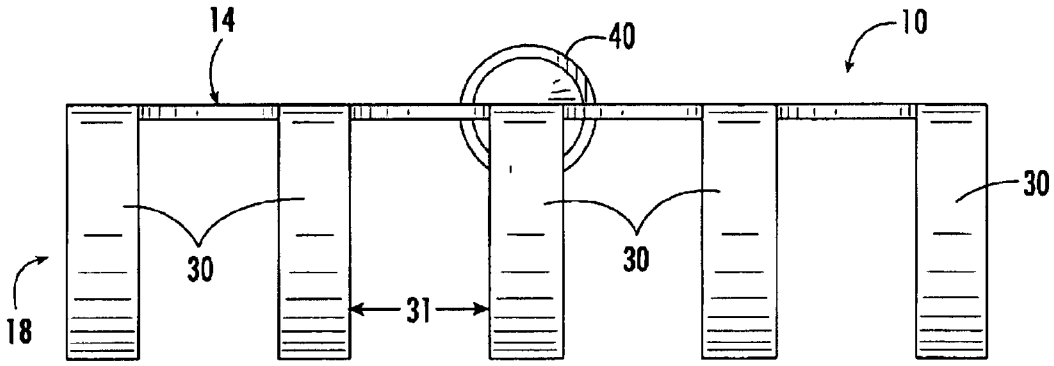
FIG. 5 is a front elevation view of the embodiment of FIG. 1.
Figure 6:
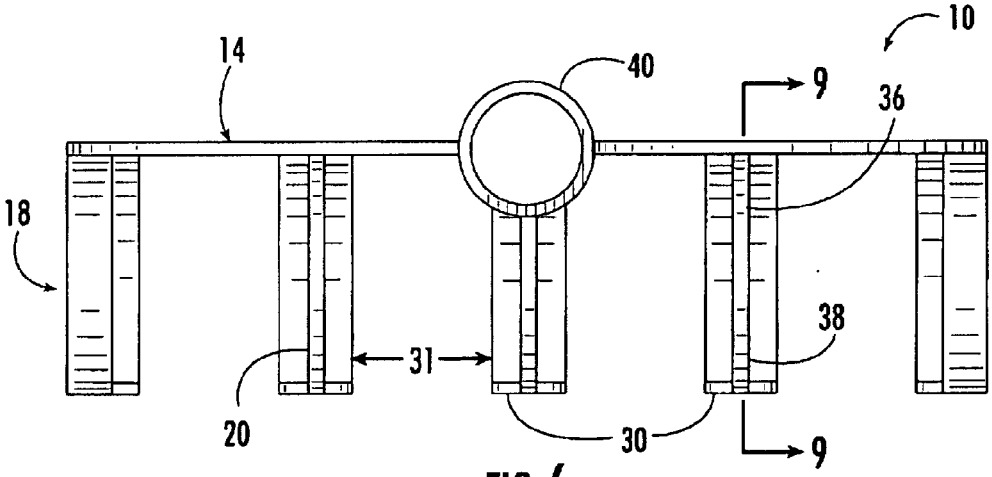
FIG. 6 is a rear elevation view of the embodiment of FIG. 1.
Figure 7:
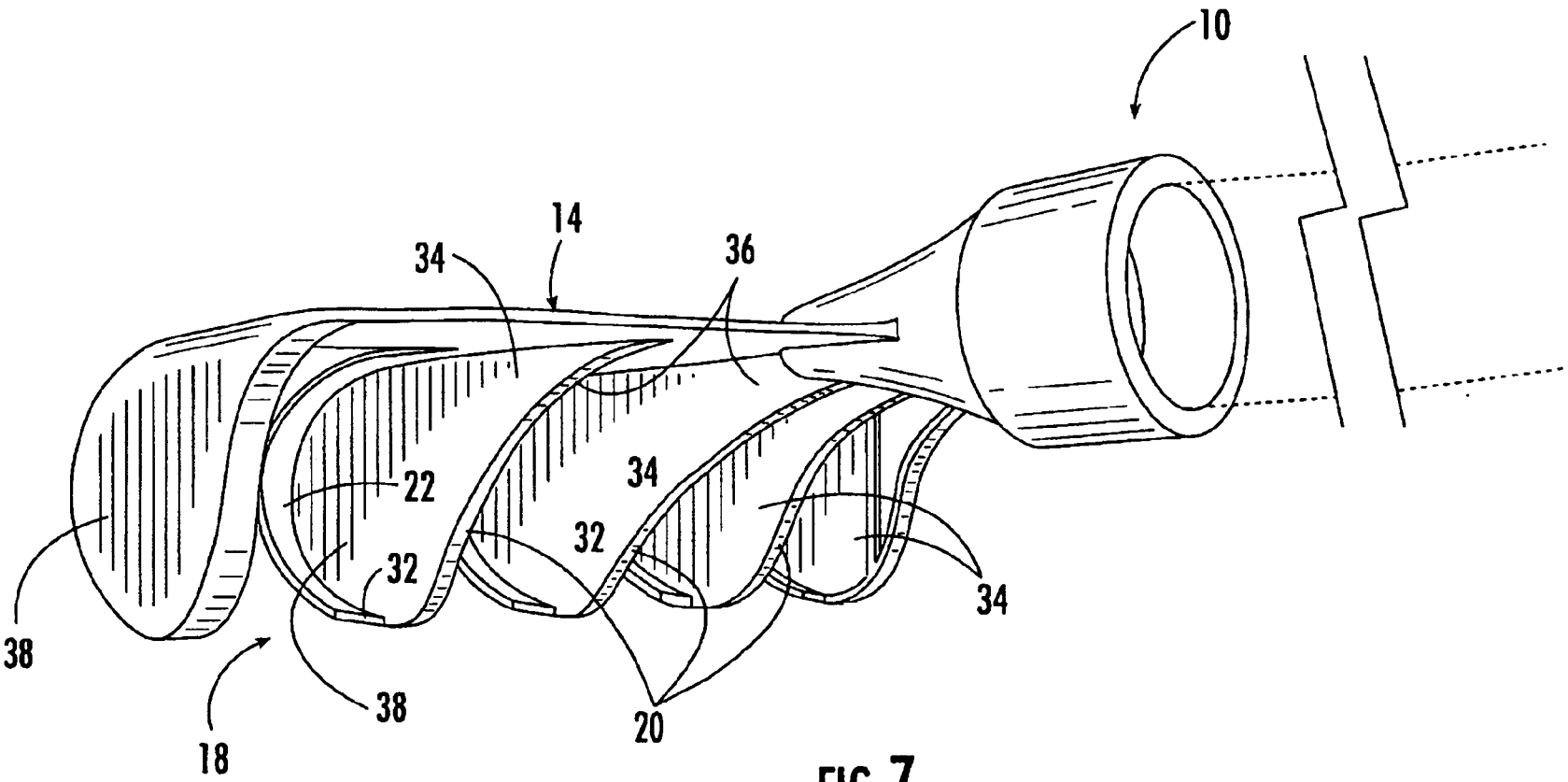
FIG. 7 is a right rear perspective view of the embodiment of FIG. 1.
Figure 9:
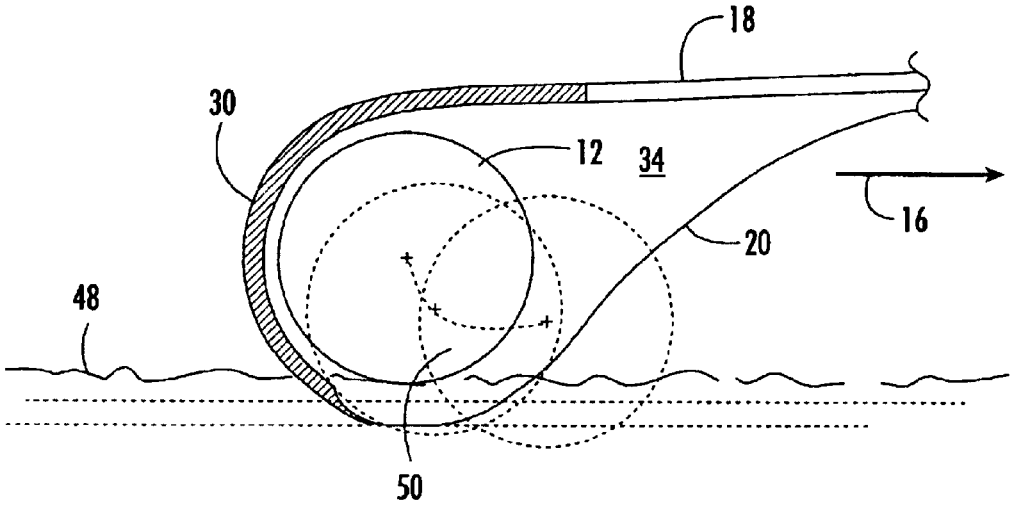
FIG. 9 is a partial cross-sectional view taken along lines 9—9 of FIG. 6 while illustrating a lifting of a ball from its embedded position within a muddy bottom surface of a water hazard.
Figure 10A:
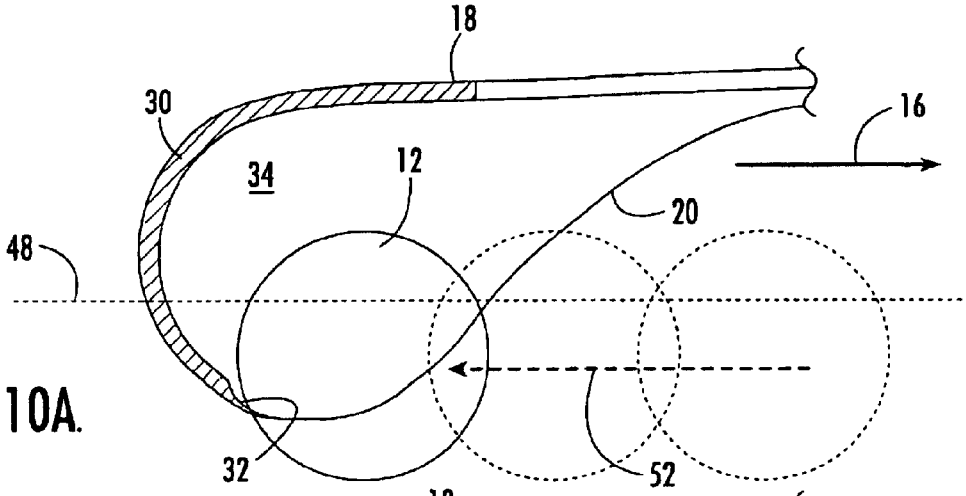
FIGS. 10A–10C are similar cross-sectional views to FIG. 8 illustrating a ball retrieval process resulting from a raking motion of the embodiment of FIG. 1, by way of further example.
Figure 10B:
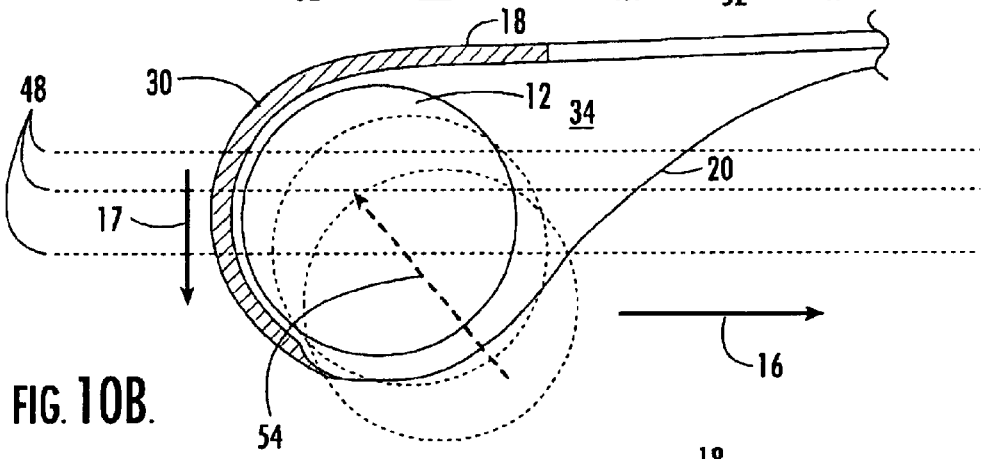
Figure 10C:
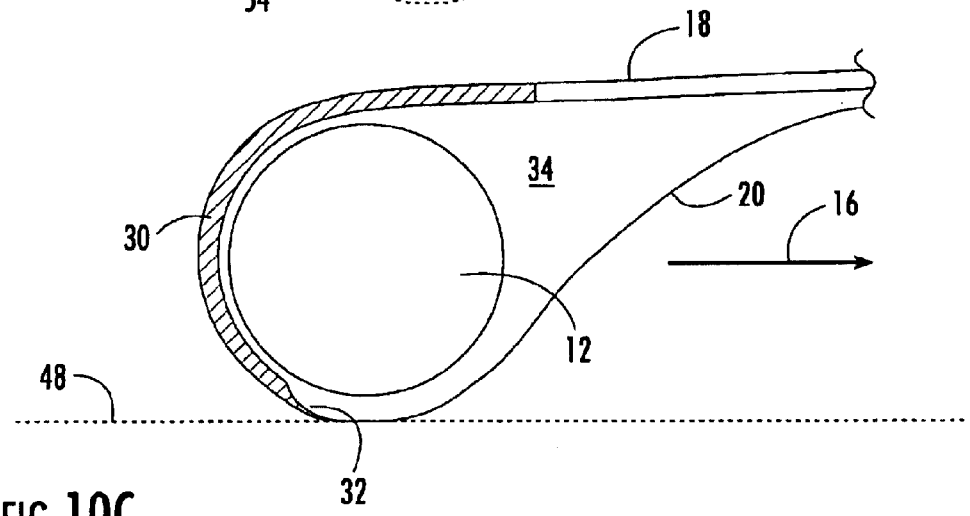
Figure 4:
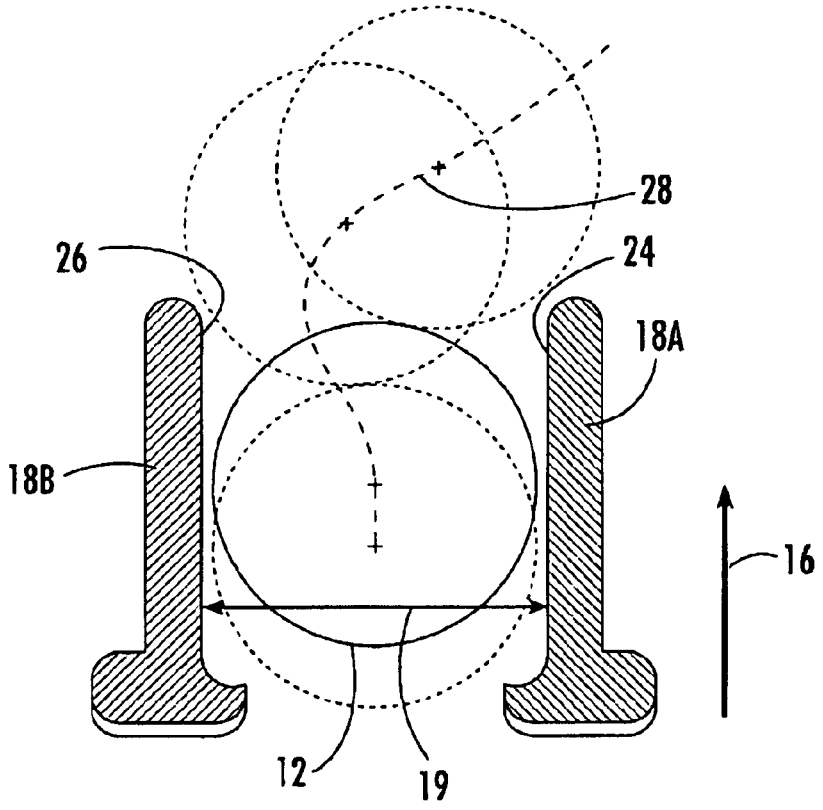
FIG. 4 is a partial cross-sectional view of an alternate embodiment to the embodiment of FIG. 1 illustrating variations in flange and tine elements without departing from the teachings of the present invention.

Referring initially to FIGS. 1–3, one embodiment of the present invention may include a device 10 for retrieving a golf ball 12, which device comprises a plate member 14 adapted for a raking movement 16 to effect the retrieval of the ball. Preferred embodiments as herein described by way of example may include multiple tines 18, with at least two spaced-apart tines 18A, 18B carried by the plate member 14. Each tine 18 (herein described by way of example with reference to tines 18A,18B) may be defined by a leading edge 20, an opposing trailing edge 22, and a surface 24 of tine 18A extending between the edges 20, 22 and spaced-apart from an opposing surface 26 of an adjacent tine 18B by a separation or a distance 19 greater than the diameter of the golf ball 12. Such an arrangement enables the two tines 18A, 18B to guide the golf ball along a path 28 from a location away from the tines 18 to a location between the surfaces 24, 26, as illustrated with reference to FIG. 4, and again to FIG. 3, by way of example, for capturing the golf ball. As illustrated with continued reference to FIGS. 1–4, and to FIGS. 5–7, a flange 30 is carried along the trailing edge 22 of each tine 18 and extends outwardly from the surfaces 24, 26 for reducing the distance 19 to a second separation or distance 31 that is less than the diameter of the golf ball 12 to thus enable a trapping of the ball 12 during the raking movement 16 of the device 10. As illustrated with reference again to FIGS. 1, 3, and 7, the flange 30 extends from the plate member 14 along the trailing edge 22 of each tine 18 for approximately 180 degrees from the plate member to a tapered end portion 32 extending from proximate the leading edge 20 of each tine 18 which permit a smooth entry into a muddy bottom surface and vegetation. The flange 30 forms a capturing rim in which to collect the ball 12, as will be herein further described. In one embodiment, the flange 30 is perpendicular to the surfaces 24, 26.

Figure 8:
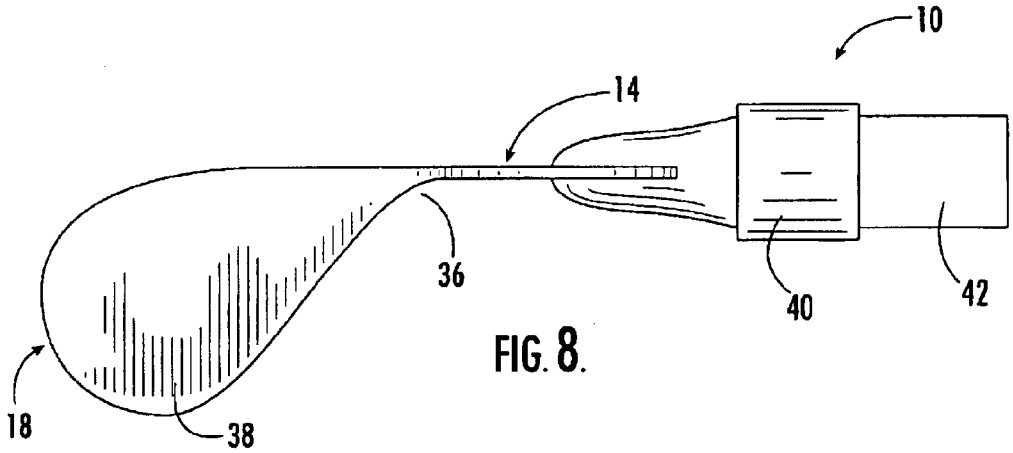
FIG. 8 is a right side elevation view of the embodiment of FIG. 1, the left elevation view being a mirror image thereof.

In one preferred embodiment of the invention as herein described by way of example and further illustrated with reference again to FIG. 7 and to FIG. 8, each tine 18 comprises a teardrop shape with the surfaces 24, 26 earlier described part of a partition wall portion 34 with the leading edge 20 extending from a stem portion 36 proximate the plate member 14 to a generally arcuate capturing portion 38.

As illustrated with reference to the above referenced drawings, and again to FIGS. 1, 2 and 7, by way of example, the plate member 14 may comprise a distal end 40 adapted for connection to a handle 42 which may further be of the telescoping type. As illustrated with reference to FIG. 2, by way of further example, the plate member 14 may preferably include an arcuate leading edge 44 extending from opposing outermost tines 18C, 18D within the array from a plate member proximal end 46 attached to each tine 18 within an array of tines as earlier described to the distal end 40. The handle 42 will allow the plate member 14 to be pulled and thus the tines 18 to be directed along a ground surface 48 having a golf ball 12 positioned thereon and even therein, as illustrated with reference to FIGS. 9 and 10A–10C.

Figure 11:
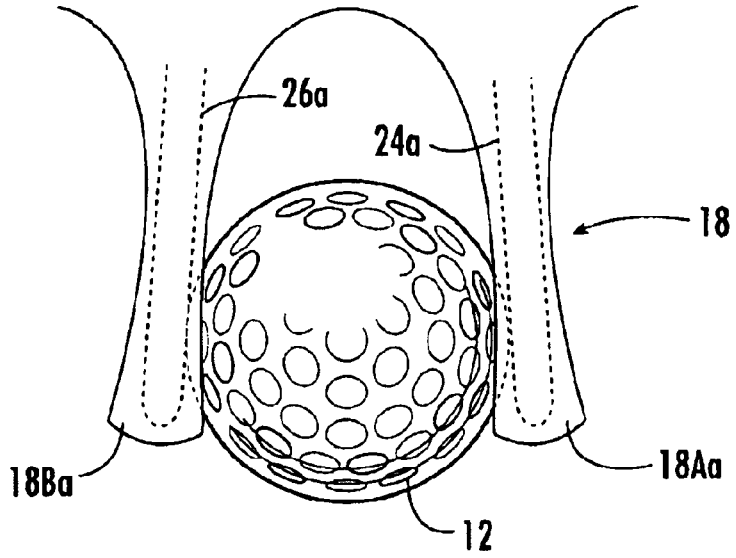
FIG. 11 is a partial view of an alternate embodiment to the embodiment of FIG. 1 illustrating non-parallel tines.

One preferred embodiment of the device 10 includes the plate member 14, the tines 18, and flanges 30 carried by the tines having a unitary construction formed from a molded plastic material. Each tine 18 is of a generally rigid construction but alternatively may be flexible. With reference again to FIG. 3, by way of illustration, the surface 24 of one tine 18A is parallel to the opposing surface 26 of the adjacent tine 18B. Alternatively, the surfaces 24, 26 may be non-parallel as illustrated with reference to an alternative embodiment as illustrated with reference to FIG. 11 for surfaces 24*a*, 26*a* with tines 18Aa and 18Ba.

By way of example with regard to the operation of the device 10, and with reference again to FIGS. 3, 4, 9, and 10A–10C, the raking movement 16 of the device 10 by pulling the handle 42 moves the plate member 14 in a direction that enables the tines 18 to be carried along the ground surface 48 in a raking manner moving the tines 18 toward a the ball 12 from the leading edge 20 to the trailing edge 22. The ball 12 is contacted by the leading edge 20 of at least one tine 18B for guiding the ball along the path 28 between the adjacent tines 18A, 18B, as illustrated by way of example with reference again to FIG. 4. Continuing the raking movement enables the flanges 30 to the contact the ball 12 in a beginning capturing movement for further positioning the ball between the tines 18A, 18B to then hold the ball within the device 10, as illustrated with reference to the paths of travel 50, 52, 54 for the tines 18 relative to the ball 12 fixed in a position on the surface 48 or embedded within the surface, as is often the case for a ball resting on the bottom of a water hazard, as illustrated with reference again to FIGS. 9 and 10A–10C. The tapered edges 32 of the flanges 30 facilitate the digging movement 17 of the tines 18 illustrated with reference again to FIG. 10A by way of example. Further, the teardrop shaped tines 18 and the arcuate leading edge 44 shape for the plate member 14 and its smooth transition for the handle 44 to the outside tines 18C, 18D enhance the moving ability of the device 10 through weeds and the like to thus avoid snagging and an inefficient ball retrieval process. Once captured within the device 10, held within the trailing edge portion by the partition wall portion 34 and the flanges 30, the device is lifted from the ground surface 48 for removing the ball 12 for reuse in a successful round of golf.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A golf ball retrieving device comprising:

a plate member adapted for a raking movement thereof;

at least two spaced apart tines carried by the plate member, each tine having a leading edge and an opposing trailing edge, and a surface extending therebetween spaced apart from an opposing surface of an adjacent tine a distance greater then a diameter of a golf ball for enabling the at least two tines to guide the golf ball therebetween; and a flange carried along the trailing edge of each tine from a lower most portion of the tine rearwardly to an uppermost portion thereof and outwardly extending from the surface therefrom for reducing the distance to less than the diameter of the golf ball while remaining in a spaced relation with the flange of the adjacent tine for trapping the golf ball during a raking movement of the device.

2. A device according to claim 1, wherein each tine is of generally rigid construction.

3. A device according to claim 1, wherein the surface of one tine is parallel to the opposing surface of the adjacent tine.

4. A device according to claim 1, wherein each tine comprises a teardrop shape partition wall and wherein the leading edge extends from a stem portion proximate the plate member to a generally arcuate capturing portion.

5. A device according to claim 1, wherein the flange includes a tapered end portion extending from the leading edge of the tine.

6. a Device according to claim 1, wherein the at least two spaced apart tines includes an array having greater than two tines therein.

7. A device according to clam 1, wherein the plate member comprises:

a distal end adapted for connection to a handle;

a proximal end attached to each of the at least two spaced apart tines; and an arcuate leading edge extending from opposing outermost tines within the at least two spaced apart tines to the distal end.

8. A device according to claim 1, further comprising a handle operable with the plate member for pulling the plate member and thus the tines along a ground surface having the golf ball positioned therewith.

9. A device according to claim 1, wherein the plate member, the at least two tines, and the flanges carried by the at least two tines have a unitary construction.

10. A device according to claim 9, wherein the unitary construction is formed from a molded plastic material.

11. A ball retrieving device comprising:

a plate member;

a plurality of tines carried by the plate member with each tine having a leading edge and an opposing trailing edge, and a surface extending therebetween spaced apart from an opposing surface of an adjacent tine a distance greater than the diameter of a ball; and a flange carried along the trailing edge of each tine from a lowermost portion of the tine rearwardly to an uppermost portion thereof and outwardly extending from the surface therefrom for reducing the distance to less than the diameter of the ball while remaining in a spaced relation with the flange of the adjacent tine for trapping the ball.

12. A device according to claim 11, wherein each tine is of generally rigid construction.

13. A device according to claim 11, wherein the surface of one tine is parallel to the opposing surface of the adjacent tine.

14. A device according to claim 11, wherein each tine comprises a teardrop shape partition wall and wherein the leading edge extends from a stem portion proximate the plate member to a generally arcuate capturing portion.

15. A device according to claim 11, wherein the flange includes a tapered end porition extending from the leading edge of each tine.

16. A device according to claim 11, wherein the plate member comprises:

a distal end adapted for connection to a handle;

a proximal end attached to each of the plurality of tines; and an arcuate leading edge extending from opposing outermost tines to the distal end.

17. A device according to claim 11, further comprising a handle operable with the plate member for pulling the plate member and thus the plurality of tines along a ground surface having a ball positioned therewith.

18. a device according to claim 11, wherein the plate member, the plurality of tines, and the flanges carried by the tines, in combination, have a unitary construction.

19. A device according to claim 18, wherein the unitary construction is formed from a molded plastic material.

20. A ball retrieving device comprising:

a plurality of tines each having a leading edge and an opposing trailing edge, and a surface extending therebetween parallel to and spaced apart from an opposing surface of an adjacent tine a distance greater than the diameter of a ball; and a flange carried along the trailing edge of each tine from a lowermost portion of the tine rearwardly to an uppermost portion thereof and outwardly extending from the surface therefrom for reducing the distance to less than the diameter of the ball while at a spaced relation with the flange of the adjacent tine for trapping the ball.

21. A device according to claim 20, wherein each tine comprises a teardrop shape partition wall and wherein the leading edge extends from a stem portion to a generally arcuate capturing portion.

22. A device according to claim 20, wherein the flange includes a tapered end portion extending from the leading edge of each tine.

23. A device according to claim 20, further comprising a plate member including:

a distal end adapted for connection to a handle;

a proximal end attached to each of the plurality of tines; and an arcuate leading edge extending from opposing outermost tines to the distal end.

24. A method of retrieving a ball comprising:

providing a plate member adapted for a raking movement thereof and at least two spaced apart generally rigid tines carried by the plate member, each tine having a leading edge and an opposing trailing edge, and a surface extending threbetween parallel to and spaced apart from an opposing surface of an adjacent tine a distance greater than the diameter of a golf ball for enabling the at least two tines to guide the golf ball therebetween, and a flange carried along the trailing edge of each tine from a lowermost portion of the tine to an uppermost portion thereof and outwardly extending from the surface therefrom for reducing the distance to less than the diameter of the golf ball and enabling a trapping thereof, wherein each flange is in a spaced relation with the flange of the adjacent tine;

moving the plate member in a direction for enabling the tines to be carried along the ground surface in a raking manner leading edge to trailing edge;

contacting a ball with the leading edge of at least one tine for guiding the ball between adjacent tines;

continuing the moving for enabling the flanges to contact the ball in a capturing movement between the adjacent tines for holding the ball; and retrieving the ball.

25. A method according to claim 24, wherein the at least two spaced apart tines includes an array having greater than two tines therein for retrieving a plurality of balls during a single raking movement.

26. A method according to claim 24, wherein the plate member moving comprises pulling a handle attached to the plate member for raking the tines along the ground surface having golf balls positioned therewith.

* * * * *